US006213897B1

(12) United States Patent
Masutani

(10) Patent No.: US 6,213,897 B1
(45) Date of Patent: Apr. 10, 2001

(54) PREPARATION OF GOLF BALLS

(75) Inventor: Yutaka Masutani, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/332,953

(22) Filed: Jun. 15, 1999

(30) Foreign Application Priority Data

Jun. 15, 1998 (JP) ..... 10-183344

(51) Int. Cl.[7] ..... A63B 37/12; A63B 37/14

(52) U.S. Cl. ..... 473/378; 264/255; 264/275; 264/279; 264/319; 473/361; 473/378; 473/384

(58) Field of Search ..... 264/319, 255, 264/279, 275; 473/361, 384, 378

(56) References Cited

U.S. PATENT DOCUMENTS

| | | | | |
|---|---|---|---|---|
| 2,376,085 | | 5/1945 | Radford et al. . | |
| 4,267,217 | * | 5/1981 | Brooker | 428/11 |
| 4,501,715 | * | 2/1985 | Barfield | 264/248 |
| 5,112,556 | * | 5/1992 | Miller | 264/279 |
| 5,122,046 | * | 6/1992 | Lavallee | 425/116 |
| 5,201,523 | * | 4/1993 | Miller | 273/233 |
| 5,225,133 | * | 7/1993 | Ihara | 264/163 |
| 5,439,227 | | 8/1995 | Egashira et al. . | |
| 5,490,674 | | 2/1996 | Hamada et al. . | |
| 5,692,973 | | 12/1997 | Dalton . | |
| 5,759,116 | * | 6/1998 | Kasasima | 473/384 |
| 5,820,485 | * | 10/1998 | Hwang | 473/361 |
| 5,824,258 | * | 10/1998 | Yamaguchi | 264/328.1 |
| 5,827,548 | * | 10/1998 | Lavallee | 425/116 |
| 5,836,834 | | 11/1998 | Masutani et al. . | |
| 5,849,237 | * | 12/1998 | Inoue | 264/319 |
| 5,874,038 | * | 2/1999 | Kasashima | 264/279 |
| 5,882,567 | * | 3/1999 | Cavallaro | 264/255 |

FOREIGN PATENT DOCUMENTS 9-285565 11/1997 (JP) .

* cited by examiner

*Primary Examiner*—Carl J. Arbes
*Assistant Examiner*—Paul D. Kim
(74) *Attorney, Agent, or Firm*—Sughrue, Mion, Zinn, Macpeak & Seas, PLLC

(57) ABSTRACT

A golf ball comprising a core, an intermediate layer, and a cover, wherein the intermediate layer is provided in its outer surface with recesses and the cover penetrates into the recesses to form protrusions, is prepared using an injection mold defining a cover-forming cavity in which a plurality of support pins are arranged for axial motion toward and away from the cavity and have distal ends with a greater diameter than the diameter of recess openings. While a spherical core body having the core enclosed within the intermediate layer is supported at the center of the mold cavity by the support pins, a cover stock is injected into the mold cavity. The support pins are withdrawn immediately before the mold cavity is filled with the cover stock.

7 Claims, 4 Drawing Sheets

PREPARATION OF GOLF BALLS

This invention relates to a method for preparing a golf ball comprising a core, an intermediate layer, and a cover, wherein the intermediate layer is provided in its outer surface with recesses and the cover penetrates into the recesses to form protrusions.

BACKGROUND OF THE INVENTION

A variety of studies and proposals have been made to find a good compromise between flight distance and "feel" of golf balls. For solid golf balls comprising a solid core and a cover, one common approach is to construct the core and the cover into multilayer structures for adjusting their hardness and dimensions (including diameter and gage).

For example, U.S. Pat No. 5,439,227 discloses a three-piece golf ball comprising a core, a cover inner layer and a cover outer layer, the cover outer layer being harder than the cover inner layer. U.S. Pat No. 5,490,674 discloses a three-piece golf ball comprising a solid core of inner and outer layers and a cover, the core inner layer being harder than the core outer layer.

While the respective layers of most golf balls define smooth spherical surfaces, the golf balls disclosed in U.S. Pat. Nos. 2,376,085 and 5,692,973 have a core which is provided with outwardly extending protrusions for preventing the core from being offset during injection molding of the cover therearound. The protrusions in these golf balls are substitutes for the support pins used during injection molding. These patents do not attempt to positively utilize the shape effect of support pin-substituting protrusions, but rather intend to avoid incorporation of a distinct material in the cover, by forming the protrusions from the same material as the cover.

Recently, JP-A 9-285565 proposes a two-piece solid golf ball in which the solid core and cover, or adjoining layers of a multilayer solid core or adjoining layers of a multilayer cover are provided with irregularities. When hit, the ball gives a different feel to the player, depending on the direction of external force applied to the ball. This golf ball is improved in feel, but insufficient in flight performance and durability. There is left a room for further improvement.

In the prior art, golf balls are often prepared by injection molding, typically by injection molding a cover around a core. One exemplary injection molding method is described with reference to FIG. 7. A mold 21 includes upper and lower sections 21*a* and 21*b* which are removably mated along a parting line P to define in the interior a spherical cavity 22 having a negative dimple pattern. A core 23 of a golf ball to be prepared is placed within the cavity 22 as an insert. The core 23 is supported in place by a plurality of support or knockout pins 24 (four pins in each of the upper and lower sections in the illustrated example). A cover stock or molding material 25 is injected into the cavity 22. The support pins 24 are withdrawn from the cover stock 25 immediately before or simultaneously with the completion of injection of the cover stock. After cooling for solidification whereby the core 23 is enclosed within the cover having a multiplicity of dimples, the upper section 21*a* is opened and the support or knockout pins 24 are moved upward from the lower section 21*b* for separating the molded golf ball from the lower section 21*b*. Then, the molded golf ball is taken out of the mold. In FIG. 7, the mold is provided with gas venting holes 26, in which stationary pins 27 are fixedly received to define gaps 28 therebetween. During molding operation, gases, typically air, are discharged from the cavity 22 to the exterior through the gaps 28, and vent holes 26.

Some consideration is needed when such an injection molding method is applied to a spherical core body in the form of a core enclosed within an intermediate layer having a multiplicity of recesses in its outer surface, more particularly when the spherical core body is supported at the center of the mold cavity by support pins and a cover stock is fed into the cavity. Usually, at least the distal ends of the support pins are carefully configured to minimize the formation of pin marks on the cover. The inventor found that it often occurs that some support pins 24 enter recesses 3 in the intermediate layer 2 around the core 1 while the remaining support pins 24 abut the intermediate layer 2 as shown in FIGS. 5 and 6. Then the spherical core body 4 consisting of the core 1 and the intermediate layer 2 is supported off the center of the mold cavity as best shown in FIG. 6. As a result of off-centering of the spherical core body 4, the molded golf ball becomes of poor quality.

SUMMARY OF THE INVENTION

An object of the invention is to provide a novel and improved method for preparing a golf ball comprising a core, an intermediate layer having a multiplicity of recesses, and a cover penetrating into the recesses to form protrusions, the method being capable of preparing golf balls with high precision while preventing any off-centering.

The invention provides a method for preparing a golf ball comprising a core of at least one layer, an intermediate layer enclosing the core, and a cover of at least one layer enclosing the intermediate layer, wherein the intermediate layer is provided in its outer surface with a multiplicity of recesses each defining an opening in the outer surface, and the cover penetrates into the recesses in the intermediate layer to form protrusions. The method involves the steps of providing a spherical core body having the core enclosed within the intermediate layer having the recesses; furnishing an injection mold defining a cover-forming cavity in the interior, in which a plurality of support pins are arranged for axial motion toward and away from the cavity and have distal ends with a greater diameter than the diameter of the recess openings; supporting the spherical core body at the center of the mold cavity by the support pins; injecting a cover stock into the mold cavity; and withdrawing the support pins from within the mold cavity immediately before the mold cavity is filled with the cover stock.

Since the distal ends of the support pins are formed to a greater diameter than the diameter of the recess openings in the intermediate layer, the support pins do not enter the recesses in the intermediate layer. This ensures that the spherical core body is always held at the center of the mold cavity, enabling high precision molding of golf balls having cores correctly centered.

BRIEF DESCRIPTION OF THE DRAWINGS

The above objects, features and advantages of the invention will be better understood by reading the following description, taken in conjunction with the accompanying drawings.

DESCRIPTION OF THE PREFERRED EMBODIMENTS

Figure 1:
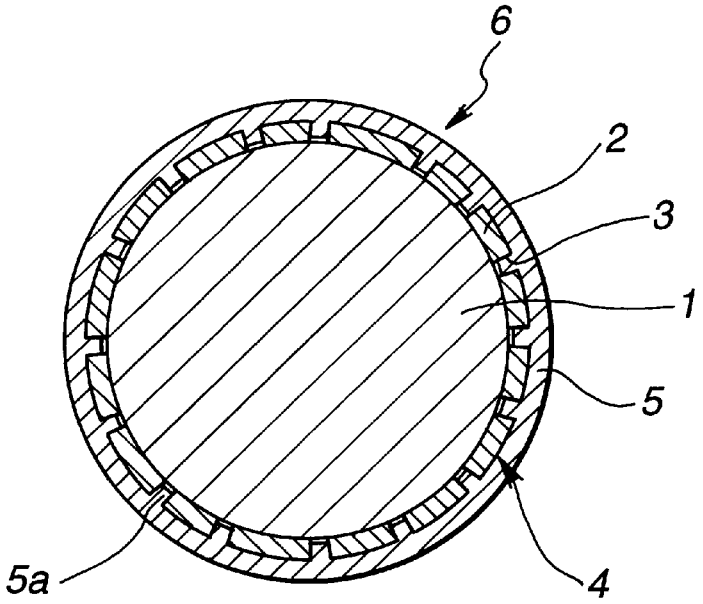
FIG. 1 is a schematic cross-sectional view of one exemplary golf ball to be prepared by the method of the invention.

Referring to FIG. 1, there is illustrated in cross section one exemplary multi-piece golf ball which can be prepared by the method of the invention. The multi-piece golf ball designated at 6 includes a solid core 1, an intermediate layer 2 enclosing the core, and a cover 5 enclosing the intermediate layer 2. The solid core 1 enclosed within the intermediate layer 2 is designated a spherical core body 4. If desired, the core 1 or the cover 5 or both are formed from two or more layers. The intermediate layer 2 is provided in its outer surface with a multiplicity of recesses 3 each defining an opening in the outer surface, and the cover 5 penetrates into the recesses 3 in the intermediate layer 2 to form convex protrusions 5*a*.

The solid core is formed of a rubber composition primarily comprising a base rubber containing polybutadiene rubber as a main component. The polybutadiene used herein Is preferably 1,4-cis-polybutadiene containing at least 40% of cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent may also be blended, preferably in an amount of about 0.1 to 5 parts by weight per 100 parts by weight of the base rubber. In the rubber composition, zinc oxide or barium sulfate may be blended as an antioxidant or specific gravity adjusting filler. The amount of filler blended is preferably about 5 to 130 parts by weight per 100 parts by weight of the base rubber.

One preferred formulation of the solid core-forming rubber composition Is given below.

| | Parts by weight |
|---|---|
| Cis-1,4-polybutadiene | 100 |
| Zinc oxide | 5 to 40 |
| Zinc acrylate | 15 to 40 |
| Barium sulfate | 0 to 40 |
| Peroxide | 0.1 to 5.0 |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

The solid core is preferably made relatively large to a diameter of 28 to 38 mm, more preferably 30 to 37 mm. With a core diameter of less than 28 mm, it would be difficult to dispose the intermediate layer having protrusions penetrated therein near the surface-adjoining region of a ball where stresses concentrate upon impact. A core diameter of more than 38 mm would require the thickness of the intermediate layer and cover to be reduced. In either case, the benefits of the invention are not always obtained.

Preferably the core has a Shore D hardness of 20 to 50, more preferably 25 to 45, and a deflection under a load of 100 kg of 2.5 to 5.0 mm, more preferably 3.0 to 4.5 mm. The weight of the core is usually about 12 to about 35 grams.

The core is usually formed to a single layer structure from one material although it may also be formed to a multilayer structure of two or more layers of different materials if desired.

The intermediate layer is preferably formed primarily of a resin having a relatively high Izod impact strength of at least 50 J/m. Exemplary resins include polyester resins, polyester elastomers, polyurethane resins, ionomer resins, styrene elastomers, hydrogenated butadiene rubber and mixtures thereof, with the polyester resins being preferred. Use may be made of commercially available polyester resins such as Hytrel 3078, 4047, and 4767 from Toray Dupont K.K. The Izod impact strength is measured according to JIS K-7110. The resin should preferably have an Izod impact strength of at least 50 J/m, more preferably from 100 J/m to less than the value at failure. An Izod impact strength of less than 50 J/m is undesirable because the durability of the ball against shots would be lost.

Preferably the intermediate layer-forming resin has a Shore D hardness of 15 to 55, more preferably 20 to 50, and a melting point of 120 to 220° C., more preferably 140 to 200° C. The intermediate layer (excluding recesses) preferably has a thickness of 1 to 6 mm, more preferably 1.5 to 5 mm.

The intermediate layer is formed around the core by conventional injection or compression molding. Preferably the intermediate layer at its outer surface is provided with a multiplicity of recesses at the same time as its molding. Specifically, the cavity of a mold for forming the intermediate layer is formed on its inner surface with a multiplicity of protrusions corresponding to the multiplicity of recesses. This mold enables that the intermediate layer having a multiplicity of recesses in its outer surface be formed by conventional injection molding. In some cases, after a smooth intermediate layer is formed around the core, recesses can be formed in the intermediate layer by engraving, drilling or any other means. While the recesses are formed, the remaining area of the intermediate layer defines a substantially spherical or convex outer surface.

According to the invention, a cover stock or molding material is molded around the intermediate layer having a multiplicity of recesses in its outer surface by conventional injection molding, whereby the cover having protrusions embedded in the intermediate layer is formed.

Any of well-known cover stocks may be used in forming the cover. The cover material may be selected from ionomer resins, polyurethane resins, polyester resins and balata rubber. Use may be made of commercially available ionomer resins such as Surlyn (E. I. Dupont) and Himilan (Mitsui Dupont Polychemical K.K.).

Additives such as titanium dioxide and barium sulfate may be added to the cover stock for adjusting the specific gravity and other properties thereof. Other optional additives include UV absorbers, antioxidants, and dispersants such as metal soaps. The cover may have a single layer structure of one material or be formed to a multilayer structure from layers of different materials.

The cover (excluding the protrusions embedded in the recesses in the intermediate layer) preferably has a thickness of 0.5 to 2.5 mm, more preferably 1.0 to 2.0 mm. The cover resin preferably has a Shore D hardness of 45 to 70, more preferably 50 to 65 and a melting point of 60 to 150° C., more preferably 70 to 120° C.

Referring to FIG. 1 again, the intermediate layer 2 is uniformly provided with a multiplicity of recesses 3. The cover layer 5 penetrates into the recesses 3 to form protrusions 5*a* therein. The total number of recesses in the outer surface of the intermediate layer (or the total number of protrusions from the cover) is usually about 80 to about 500, preferably about 90 to about 400. The recesses are distributed on the spherical outer surface of the intermediate layer, preferably in a regular arrangement, for example, a regular octahedral or regular icosahedral arrangement as is well known for the dimple arrangement. The recesses preferably have a depth of 1.0 to 6.0 mm, more preferably 1.5 to 5.0 mm. The depth of recesses is equal to the length of protrusions. The shape of recesses or protrusions is not critical and they may be formed to an appropriate shape such as cylinder, cone, prism, pyramid, frusto-cone or frusto-pyramid.

The Shore D hardness of the cover resin forming the protrusions is higher than the Shore D hardness of the intermediate layer-forming resin. The hardness difference is at least 8 Shore D units, preferably 10 to 50 Shore D units. With a hardness difference of less than 8 Shore D units, the boundaries between the protrusions and the recesses would become less definite so that the penetrating effect of protrusions becomes weak.

The melting point of the cover resin forming the protrusions is lower than the melting point of the intermediate layer-forming resin. The melting point difference is preferably at least 10° C., more preferably 30 to 150° C. A melting point difference of less than 10° C. allows the intermediate layer to be melted during molding of the cover thereon, sometimes failing to figure the protrusions accurately to the desired shape.

The protrusions each have a top and a base, and the cross section of the protrusions at their base may have a circular, triangular, rectangular or other shape. The size of the cross section of the protrusions at their base, which is a diameter for the circular planar shape, the longest side for the triangular planar shape, or the longest diagonal for the rectangular and other planar shapes, is preferably from 0.5 mm to 5.0 mm, more preferably from 1.0 mm to 4.0 mm, most preferably from 0.8 mm to less than 3.5 mm. This cross-section size is preferably not more than 95%, preferably 10 to 90% of the thickness of the intermediate layer. If the protrusion cross-section size is more than 95% of the intermediate layer thickness, the protrusions would become less liable to buckling, failing to achieve the effect of the invention.

As described above, the golf ball which is prepared by the method of the invention in one preferred embodiment has the intermediate layer provided with a multiplicity of recesses and the cover not only enclosing the intermediate layer, but also penetrating into the recesses to form protrusions in fit therewith wherein the resinous material of the cover including the protrusions is harder than the resinous material of the intermediate layer having a relatively high impact strength as demonstrated by an Izod impact strength of at least 50 J/m. When hit with a driver at a relatively high head speed, the ball undergoes a considerable deformation because the cover protrusions in the intermediate layer undergoes a buckling phenomenon. Owing to a reduced backspin rate and an increased launch angle, the ball travels a markedly increased carry.

When hit with a short iron at a relatively low head speed, the ball is restrained from deformation because the cover protrusions in the intermediate layer does not buckle. Owing to an increased backspin rate, the ball is easy to control. With respect to the "feel" of the ball when hit, the ball gives a feel in proportion to the amount of deformation, that is, a soft pleasant feel on driver shots and a tight full-body feel on short iron shots.

The golf ball as a whole preferably has a hardness corresponding to a deflection of 2.6 to 4.0 mm, more preferably 2.8 to 3.8 mm, under a load of 100 kg. The golf ball must have a diameter of not less than 42.67 mm and a weight of not greater than 45.93 grams in accordance with the Rules of Golf.

According to the invention, a golf ball as described above is prepared by providing a spherical core body having the core enclosed within the intermediate layer having recesses, furnishing an injection mold defining a cover-forming cavity in the interior, in which a plurality of support pins are arranged for axial motion toward and away from the cavity and have distal ends with a greater diameter than the diameter of the recess openings, supporting the spherical core body at the center of the mold cavity by the support pins, injecting a cover stock into the mold cavity, and withdrawing the support pins from within the mold cavity immediately before the mold cavity is filled with the cover stock.

Figure 2:
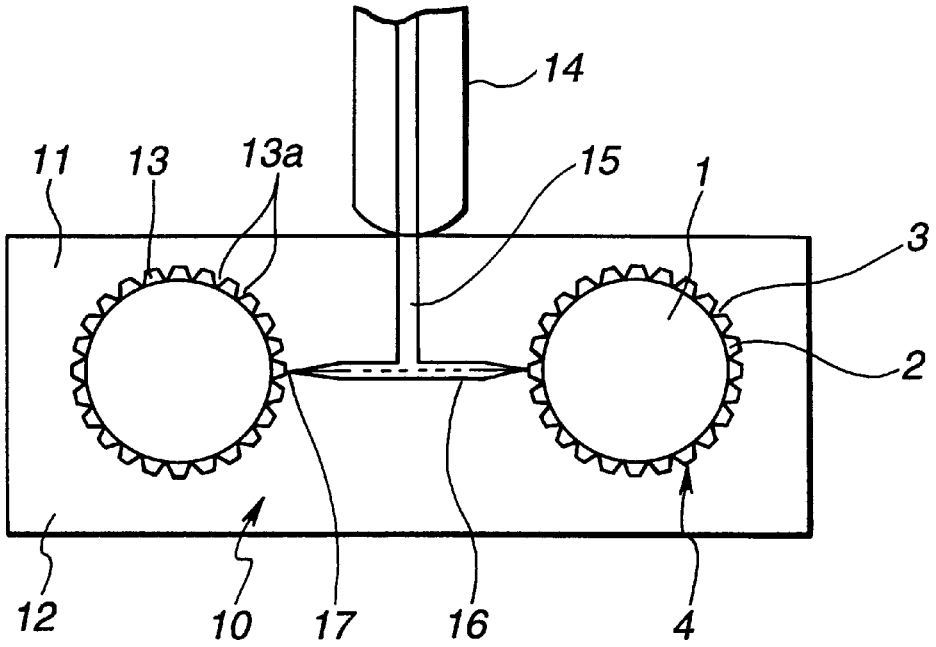
FIG. 2 is a schematic view of a mold for illustrating the step of forming around a core an intermediate layer having recesses according to the method of the invention.

Referring to FIG. 2, one exemplary step of enclosing the core 1 within the intermediate layer 2 having a multiplicity of recesses 3 to form a spherical core body 4 is illustrated. A mold 10 includes upper and lower sections 11 and 12 which define a generally spherical cavity 13 when mated together. The mold wall defining the cavity 13 is provided with a multiplicity of projections 13*a* corresponding to the recesses 3. The mold 10 further includes a sprue 15 connected to an injecting machine 14, a runner 16, and a gate 17, all in fluid communication. After the core 1 is placed in the mold cavity 13, an intermediate layer-forming material is injected and fed from the injecting machine 14 into the space between the core 1 and the cavity wall and among the projections 13*a*, through the sprue 15, runner 16 and gate 17, thereby forming the spherical core body 4.

Figure 3:
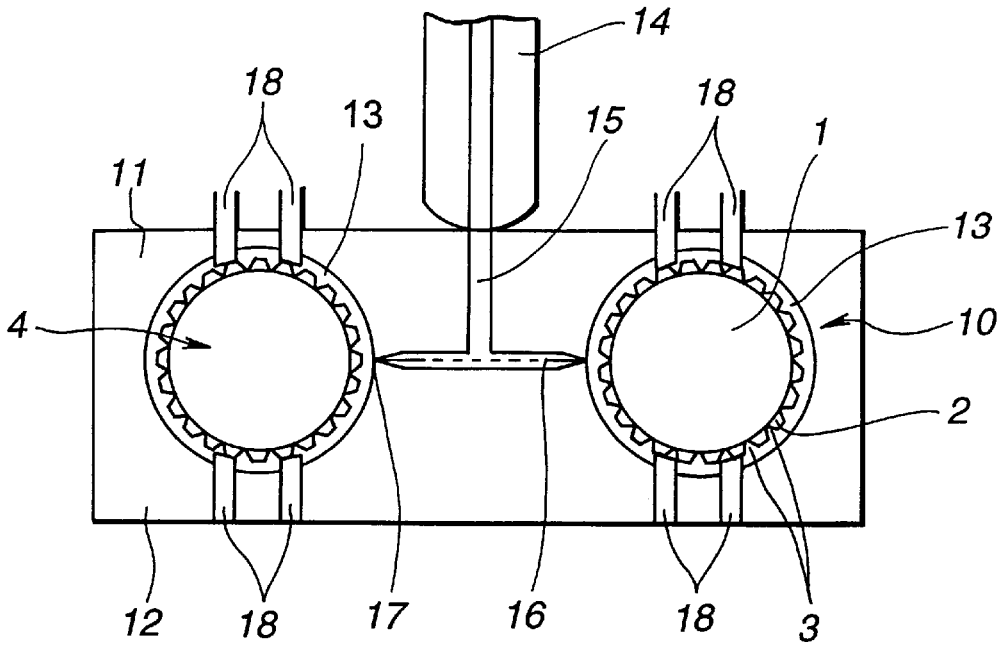
FIG. 3 is a schematic view of another mold for illustrating the step of injecting a cover stock around a spherical core body according to the method of the invention.

FIG. 3 illustrates one exemplary step of enclosing the spherical core body 4 within the cover 5 to form a golf ball. (In FIGS. 2 and 3, the same parts are designated by like numerals although a cavity size and the like are somewhat different.) A mold 10 includes upper and lower sections 11 and 12 which define a generally spherical cavity 13 when mated together. The mold wall defining the cavity 13 is provided with a negative dimple pattern though not shown. The mold 10 further includes a sprue 15 connected to an injecting machine 14, a runner 16, and a gate 17, all in fluid communication. A plurality of support pins 18 are arranged in the mold near the opposite poles of the spherical cavity 13 for axial motion toward and away from the cavity. After the spherical core body 4 is supported at the center of the mold cavity 13 by the support pins 18, a cover stock is injected and fed from the injecting machine 14 into the space between the spherical core body 4 and the cavity wall, through the sprue 15, runner 16 and gate 17, during which the cover stock also penetrates into the recesses 3 in the intermediate layer 2, thereby molding the cover 5 having protrusions 5*a* embedded in the intermediate layer 2. The support pins 18 are withdrawn from within the cavity 13 immediately before the cavity 13 is completely filled with the cover stock.

It is noted that each recess defines an opening at the outer surface of the intermediate layer, and each support pin has a distal end on the cavity side. According to the invention, at least the distal end of each support pin is formed to a greater diameter than the diameter of the recess opening. Since the large diameter distal ends prevent the support pins 18 from entering the recesses 3, the spherical core body 4 is always held at the center of the mold cavity 13.

When the spherical core body 4 is supported by the support pins 18, there is a chance that some support pins 18 block recesses 3 because the distal ends of the support pins 18 are larger than the recesses 3. The blockage of recesses with pins gives rise to no problem for the following reason. The mold is constructed such that the cover stock is fed into the cavity at the parting line between the upper and lower sections (that is, the equator of the golf ball) as shown in FIG. 3, flows within the cavity upward and downward as viewed in FIG. 3, and merges at the top and bottom of the cavity (that is, the north and south poles of the golf ball). The support pins 18 are arranged in the mold near the north and south poles of the spherical cavity so that the pins support the ball near its north and south poles. Then, if the support pins 18 are withdrawn immediately before the completion of filling of the cavity with the cover stock and retracted from within the cavity, then the cover stock can flow into those recesses 3 which have been blocked with the support pins 18. As a consequence, the cover 5 is molded in a sound state.

In one preferred embodiment, the diameter of the distal end of each support pin is 1.2 to 4.5 times the diameter of each recess opening in the intermediate layer. Understandably, the diameter of the recess opening is equal to the size of the cross section of the protrusion at its base.

EXAMPLE

Examples of the invention are given below by way of illustration and not by way of limitation.

Example I

Solid cores A to G were formed by working rubber compositions of the formulation shown in Table 1 in a kneader and molding and vulcanizing them in molds at a temperature of 155° C. for about 15 minutes. Intermediate layers were formed around the cores by injection molding resin compositions of the formulation shown in Table 2. The combination of core and intermediate layer is shown in Table 3. The intermediate layer-forming molds used herein had a plurality of cylindrical projections distributed on their cavity-defining inner surface in a regular octahedral arrangement. The number, base cross-section size (diameter) and length of the projections on the intermediate layer-forming mold correspond to those of protrusions on the cover and are reported in Table 3.

Covers were formed around the intermediate layers by injection molding cover stocks of the formulation shown in Table 2. The combination of cover with other components is shown in Table 3. Conventional paint was applied to the covers, obtaining three-piece golf balls.

In the cover-injecting mold, three support pins were arranged for each of the upper and lower sections. Each pin had a diameter which was twice the diameter of the recess opening in the intermediate layer (equal to the base cross-section size of the protrusions shown in Table 3).

Among the molded golf balls, those balls in which the spherical core body was off-centered or the protrusions are defective were rejected. Among 200 golf balls molded, five or less were rejected, indicating a percent rejection of 2.5% or less.

These golf balls were examined for hardness, flight performance and feel by the following tests. The results are shown in Tables 3 and 4.

Ball Hardness

Hardness is expressed by a deflection (mm) under a load of 100 kg.

Flight Performance

Using a swing robot, the golf ball was struck with different clubs at different head speeds. A spin rate, initial velocity, carry, total distance, and roll were measured.

(1) driver, head speed 45 m/s (W#1/HS45)

(2) driver, head speed 35 m/s (W#1/HS35)

(3) No. 5 iron, head speed 39 m/s (I#5/HS39)

(4) No. 9 iron, head speed 35 m/s (I#9/HS35)

The driver club used was Tour Stage X100 with a loft angle of 10°, and the iron club was Tour Stage X1000, both available from Bridgestone Sports Co., Ltd.

Feel

The balls were hit by three professional golfers using a driver and pitching wedge. The feel of the balls upon impact was rated by the golfers according to the following criteria.

Exc.: excellent feel
Good: good feel
Fair: ordinary feel
Poor: unpleasant feel

TABLE 1

| | Core | | | | |
|---|---|---|---|---|---|
| Rubber compound (pbw) | A | B | C | D | E |
| JSR BR01 | 100.0 | 100.0 | 100.0 | 100.0 | 100.0 |
| Zinc acrylate | 20.0 | 25.0 | 25.0 | 20.0 | 25.0 |
| Zinc oxide | 10.0 | 10.0 | 10.0 | 10.0 | 10.0 |

TABLE 1-continued

| Rubber compound (pbw) | Core A | B | C | D | E |
|---|---|---|---|---|---|
| Barium sulfate | 17.4 | 15.2 | 10.1 | 10.2 | 14.5 |
| Dicumyl peroxide | 1.2 | 1.2 | 1.2 | 1.2 | 1.2 |

JSR BR01 is the trade name of polybutadiene rubber by Japan Synthetic Rubber K.K.

TABLE 2

| Resin blend (pbw) | Intermediate layer/Cover 1 | 2 | 3 | 4 | 5 |
|---|---|---|---|---|---|
| Hytrel 3078 | 100 | — | — | — | — |
| Hytrel 4047 | — | 100 | — | — | — |
| Hytrel 4767 | — | — | 100 | — | — |
| Himilan 1605 | — | — | — | 50 | — |
| Himilan 1650 | — | — | — | — | 40 |
| Himilan 1706 | — | — | — | 50 | — |
| Surlyn 8120 | — | — | — | — | 60 |
| Titanium oxide | — | — | — | 5 | 5 |
| Izod impact strength (J/m) | NB | NB | 154 | — | — |

Hytrel is the trade name of polyester base thermoplastic elastomer by Toray Dupont K.K.; Himilan is the trade name of ionomer resin by Mitsui Dupont Polychemical K.K.; and Surlyn is the trade name of ionomer resin by E. I. Dupont. NB means that a specimen was not broken.

TABLE 3

| | Example 1 | 2 | 3 | 4 | 5 |
|---|---|---|---|---|---|
| Core | | | | | |
| Compound | A | B | C | D | E |
| Diameter (mm) | 30.5 | 30.5 | 35.3 | 36.3 | 28.3 |
| Weight (g) | 17.5 | 17.5 | 26.4 | 28.4 | 13.9 |
| Specific gravity | 1.176 | 1.176 | 1.147 | 1.134 | 1.172 |
| Hardness* (mm) | 3.9 | 3.5 | 3.5 | 4.1 | 3.4 |
| Intermediate layer | | | | | |
| Blend | 1 | 1 | 2 | 3 | 2 |
| mp. (° C.) | 154 | 154 | 182 | 199 | 182 |
| Diameter** (mm) | 38.5 | 38.5 | 40.3 | 40.3 | 40.3 |
| Thickness (mm) | 4.0 | 4.0 | 2.5 | 2.0 | 6.0 |
| Weight** (g) | 34.7 | 34.7 | 39.0 | 39.0 | 39.0 |
| Specific gravity | 1.15 | 1.15 | 1.12 | 1.15 | 1.12 |
| Hardness (Shore D) | 30 | 30 | 40 | 47 | 40 |
| Cover | | | | | |
| Blend | 4 | 5 | 5 | 4 | 5 |
| mp. (° C.) | 90 | 85 | 85 | 90 | 85 |
| Thickness (mm) | 2.1 | 2.1 | 1.2 | 1.2 | 1.2 |
| Weight (g) | 10.6 | 10.6 | 6.3 | 6.3 | 6.3 |
| Specific gravity | 0.97 | 0.97 | 0.97 | 0.97 | 0.97 |
| Hardness (Shore D) | 62 | 52 | 52 | 62 | 52 |
| Protrusions | | | | | |
| Number | 152 | 344 | 344 | 344 | 120 |
| Cross-section size (mm) | 1.0 | 1.5 | 1.0 | 0.5 | 2.5 |
| Length (mm) | 4.0 | 4.0 | 2.5 | 2.0 | 6.0 |

*deflection (mm) under a load of 100 kg
**value for core and intermediate layer combined

TABLE 4

| | Example 1 | 2 | 3 | 4 | 5 |
|---|---|---|---|---|---|
| Ball | | | | | |
| Diameter (mm) | 42.7 | 42.7 | 42.7 | 42.7 | 42.7 |
| Weight (g) | 45.3 | 45.3 | 45.3 | 45.3 | 45.3 |
| Hardness (mm) | 3.1 | 3.6 | 3.2 | 3.0 | 3.2 |
| W#1/HS45 | | | | | |
| Spin (rpm) | 2760 | 2860 | 2790 | 2920 | 2690 |
| Carry (m) | 214.9 | 216.6 | 215.7 | 215.3 | 213.1 |
| Total (m) | 223.5 | 221.4 | 223.2 | 220.6 | 219.8 |
| Initial velocity (m/s) | 68.1 | 68.0 | 68.1 | 68.0 | 67.9 |
| W#1/HS35 | | | | | |
| Spin (rpm) | 4130 | 4270 | 4160 | 4360 | 4010 |
| Carry (m) | 141.2 | 142.1 | 141.5 | 142.7 | 139.7 |
| Total (m) | 160.4 | 159.0 | 160.2 | 158.4 | 157.2 |
| I#5/HS39 | | | | | |
| Spin (rpm) | 6270 | 6650 | 6230 | 6590 | 6150 |
| Carry (m) | 155.3 | 153.6 | 155.1 | 153.9 | 154.7 |
| Total (m) | 159.7 | 156.7 | 159.0 | 156.9 | 158.9 |
| Roll (m) | 4.4 | 3.1 | 3.9 | 3.0 | 4.2 |
| I#9/HS35 | | | | | |
| Spin (rpm) | 9210 | 9660 | 9090 | 9570 | 9030 |
| Carry (m) | 125.2 | 123.8 | 124.9 | 124.0 | 124.7 |
| Total (m) | 127.2 | 124.7 | 127.1 | 125.2 | 126.4 |
| Roll (m) | 2.0 | 0.9 | 2.2 | 1.2 | 1.7 |
| Feel | | | | | |
| Driver | Good | Exc. | Exc. | Exc. | Fair |
| Pitching wedge | Exc. | Exc. | Exc. | Exc. | Good |

Example II & Comparative Example

Golf balls were prepared as in Example I using the core of rubber compound A, the intermediate layer of resin blend 1, and the cover of resin blend 4. The shape of protrusions was the same as in Example I. The recess openings in the intermediate layer had different diameters of 0.6 mm, 0.8 mm, 1.5 mm, 2 mm, 2.5 mm, 3 mm, and 3.5 mm. For each of the upper and lower mold sections, there were provided three support pins having a diameter which was 0.5 to 5 times the diameter of recess openings as shown in Table 5. There were molded 200 golf balls for each type.

The golf balls were examined for defects. A percent rejection was determined by examining the following three items.

(1) Cover off-centering demonstrated by a minimum cover gage/maximum cover gage of less than 0.7

(2) Defective protrusions demonstrated by a protrusion length/recess depth of less than 0.8

(3) Defective cover demonstrated by visually perceivable defects on the cover such as support pin marks left unfilled.

Each ball was examined for each of the above items and regarded rejected if it did not pass any one of the three items. The number of rejected balls was counted, from which a percent rejection was calculated for each type.

Figure 4:
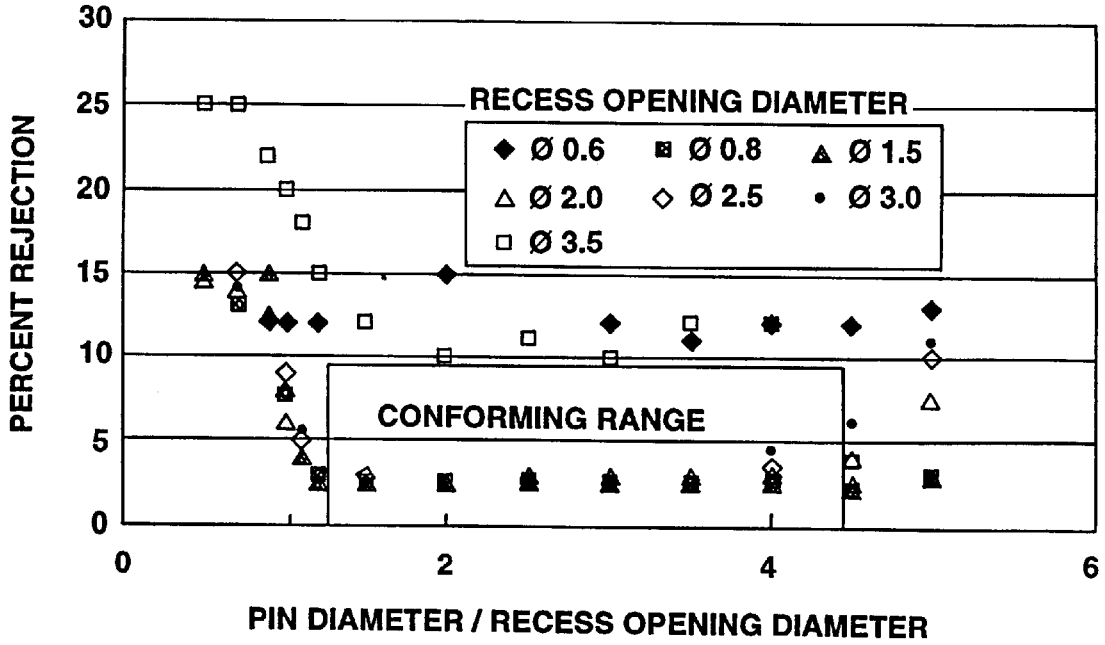
FIG. 4 is a graph showing a percent rejection versus a pin diameter/recess opening diameter ratio in Examples and Comparative Examples.
Figure 5:
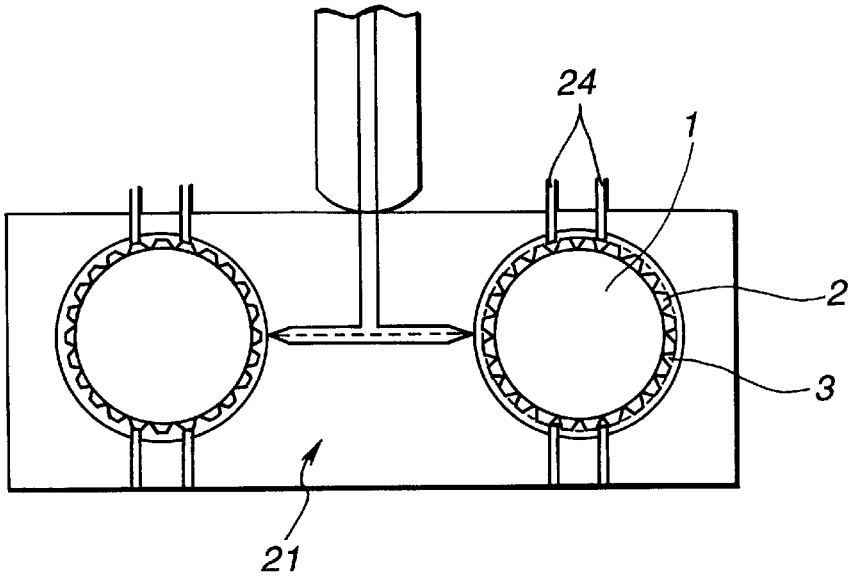
FIG.5 PRIOR ART
FIG. 5 illustrates the step of injecting a cover stock in a mold used in Comparative Example.
Figure 6:
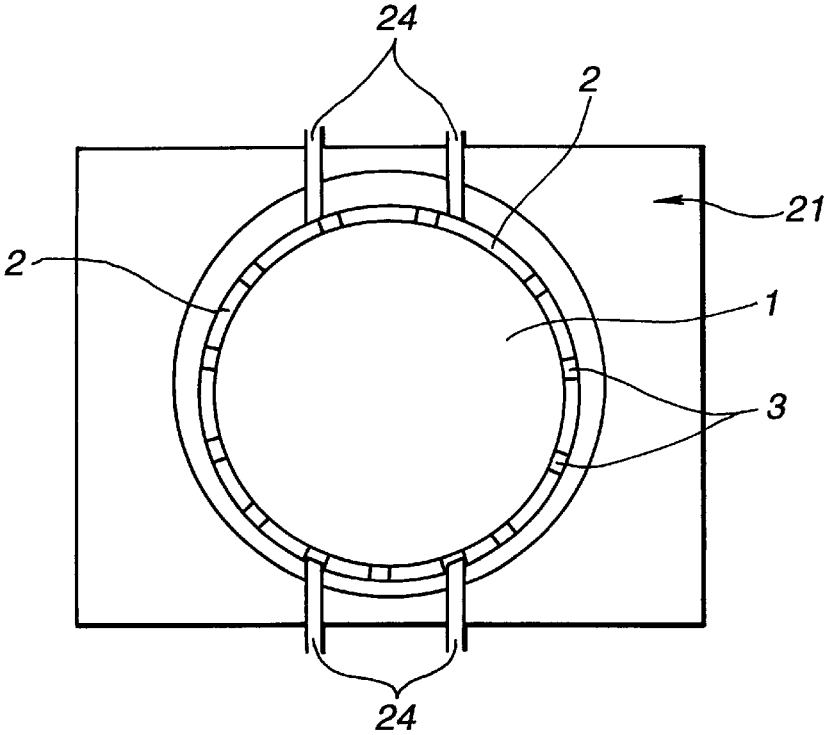
FIG.6 PRIOR ART
FIG. 6 is an enlarged view of the spherical core body supported by support pins in FIG. 5.
Figure 7:
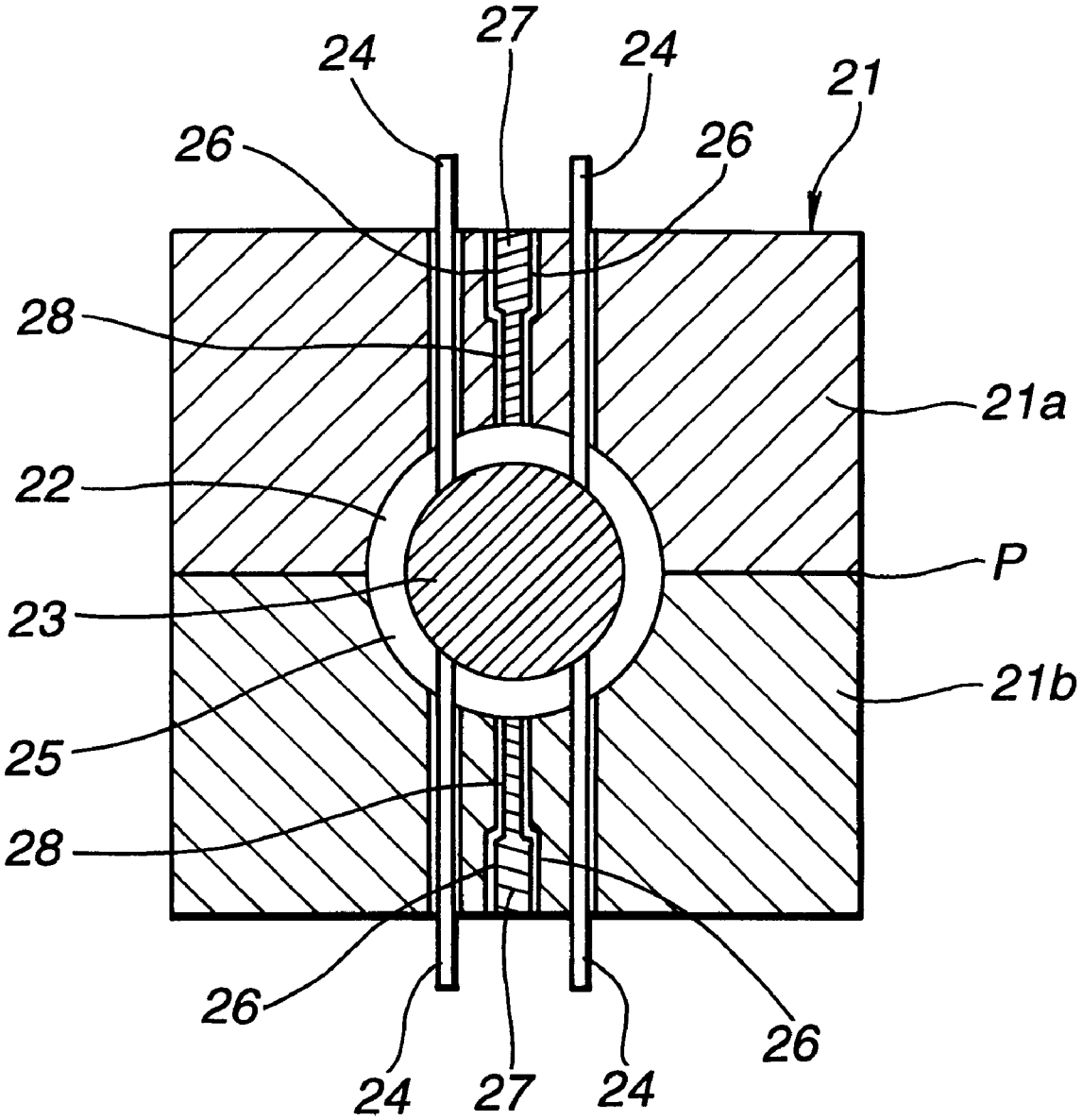
FIG.7 PRIOR ART
FIG. 7 illustrates a prior art cover injecting method.

The results are shown in Table 5 and FIG. 4.

TABLE 5

Average percent rejection for each of different recess opening diameters

| Pin diameter/ recess opening diameter | Diameter of recess opening in intermediate layer (mm) | | | | | | |
|---|---|---|---|---|---|---|---|
| | 0.6 | 0.8 | 1.5 | 2 | 2.5 | 3 | 3.5 |
| 0.5 | – | – | 15 | 14.5 | – | – | 25 |
| 0.7 | – | 13 | – | 14 | 15 | 14 | 25 |
| 0.9 | 12 | – | 15 | 12.5 | – | 12 | 22 |
| 1 | 12 | 7.5 | – | 6 | 9 | 8 | 20 |
| 1.1 | – | – | 4 | – | 5 | 5.5 | 18 |
| 1.2 | 12 | 3 | 2.5 | 3 | 3 | 2.5 | 15 |
| 1.5 | – | 2.5 | – | 2.5 | 3 | 2.5 | 12 |
| 2 | 15 | 2.5 | 2.5 | 2.5 | 2.5 | 2.5 | 10 |
| 2.5 | – | 2.5 | 2.5 | 3 | 2.5 | 3 | 11 |
| 3 | 12 | 2.5 | 2.5 | 3 | 2.5 | 3 | 10 |
| 3.5 | 11 | 2.5 | 2.5 | 3 | 3 | 3 | 12 |
| 4 | 12 | 2.5 | 2.5 | 3 | 3.5 | 4.5 | 12 |
| 4.5 | 12 | 2 | 2.5 | 4 | 4 | 6 | – |
| 5 | 13 | 3 | 3 | 7.5 | 10 | 11 | – |

Note that in Table 5, the block delimited by thick solid lines corresponds to the scope of the invention.

The invention addresses a golf ball having an intermediate layer with a multiplicity of recesses and a cover not only enclosing the intermediate layer, but also penetrating into the recesses to form protrusions in fit therewith. When hit with a driver, the ball presents a soft feel and travels an increased distance. When hit with a short iron, the ball is easy to control and presents a tight full-body feel. The method of the invention is effective for manufacturing such golf balls with high precision and in a consistent manner.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for preparing a golfball comprising a core of at least one layer, an intermediate layer enclosing the core, and a cover of at least one layer enclosing the intermediate layer, wherein the intermediate layer is provided in its outer surface with 80 to 500 recesses, each recess defining an opening in the outer surface, and the cover penetrates into the recesses in the intermediate layer to form 80 to 500 protrusions, said method comprising the steps of:

molding a resin having an Izod impact strength of at least 50 J/m around the core enclosed within the intermediate layer having 80 to 500 recesses to form a spherical core body, furnishing an injection mold defining a cover-forming cavity in the interior, in which a plurality of support pins are arranged for axial motion toward and away from the cavity and have distal ends with a greater diameter than the diameter of the recess openings, supporting the spherical core body at the center of the mold cavity by the support pins, injecting a cover stock into the mold cavity, and withdrawing the support pins from within the mold cavity immediately before the mold cavity is filled with the cover stock.

2. The method of claim 1 wherein the diameter of the recess openings in the intermediate layer is from 0.8 mm to less than 3.5 mm.

3. The method of claim 1 wherein the diameter of the distal ends of the support pins is 1.2 to 4.5 times the diameter of the recess openings in the intermediate layer.

4. The method of claim 1, wherein said step of providing a spherical body comprises the steps of molding a solid core having a diameter in the range of 28 to 38 mm made of a material having a Shore D hardness in the range of 20 to 50.

5. The method of claim 1, wherein said step of providing a spherical body comprises the step of molding said intermediate layer around said core to a thickness in the range of 1 to 6 mm using a resin having a Shore D hardness in the range of 20 to 50.

6. The method of claim 1, wherein said step of injecting a cover stock comprises the step of injecting a resin having a Shore D hardness in the range of 45 to 70 into said mold cavity to form a cover having a thickness in the range of 0.5 to 2.5 mm.

7. The method of claim 1, wherein the step of injecting a cover stock comprises the step of injecting a cover stock resin material harder than a resin to form said intermediate layer by at least 8 Shore D units.

* * * * *